US005414979A

United States Patent [19]

Moore et al.

[11] Patent Number: 5,414,979

[45] Date of Patent: May 16, 1995

[54] STRETCH WRAPPING APPARATUS

[75] Inventors: Phil Moore, Mt. Washington, Ky.; Curtis Martin, New Albany, Ind.

[73] Assignee: Lantech, Inc., Louisville, Ky.

[21] Appl. No.: 51,416

[22] Filed: Apr. 23, 1993

[51] Int. Cl.[6] ..... B65B 11/04; B65B 53/00

[52] U.S. Cl. ..... 53/556; 53/587

[58] Field of Search ..... 53/389.4, 556, 587, 53/588; 226/113, 114; 264/288.4; 425/367

[56] References Cited

U.S. PATENT DOCUMENTS

| | | | |
|---|---|---|---|
| 1,714,461 | 5/1929 | Chanier et al. . | |
| 2,005,738 | 6/1935 | Foster et al. . | |
| 2,432,828 | 12/1947 | Stone . | |
| 2,455,051 | 11/1948 | Fairbanks . | |
| 2,541,475 | 2/1951 | Lyman et al. . | |
| 2,549,271 | 4/1951 | Wienke . | |
| 2,570,773 | 10/1951 | Davis . | |
| 2,665,756 | 1/1954 | Hall . | |
| 3,374,963 | 3/1968 | Conti . | |
| 3,546,850 | 12/1970 | Hatanaka et al. . | |
| 4,302,920 | 12/1981 | Lancaster et al. . | |
| 4,413,463 | 11/1983 | Lancaster | 53/556 X |
| 4,418,510 | 12/1983 | Lancaster, III et al. . | |
| 4,514,955 | 5/1985 | Mouser et al. | 53/556 |
| 4,537,368 | 8/1985 | Radmore et al. . | |
| 4,685,270 | 8/1987 | Brambilla . | |
| 4,706,443 | 11/1987 | Humphrey | 53/556 |
| 4,729,213 | 3/1988 | Raes | 53/556 X |
| 4,747,254 | 5/1988 | Lancaster . | |
| 4,790,125 | 12/1988 | Merritt, III . | |
| 4,914,891 | 4/1990 | Soulahti . | |
| 5,014,489 | 5/1991 | Terminella et al. . | |
| 5,016,427 | 5/1991 | Thimon et al. . | |
| 5,040,358 | 8/1991 | Thimon | 53/556 |
| 5,161,349 | 11/1992 | Lancaster, III et al. . | |
| 5,186,981 | 2/1993 | Shellhamer et al. . | |

FOREIGN PATENT DOCUMENTS

| | | |
|---|---|---|
| 220712A | 5/1987 | European Pat. Off. . |
| 0289092 | 11/1988 | European Pat. Off. . |
| 0293352 | 11/1988 | European Pat. Off. . |
| 2606365 | 5/1988 | France . |
| 2083002A | 3/1982 | United Kingdom . |

OTHER PUBLICATIONS

U.S. patent application, Ser. No. 07/611,114 filed Nov. 9, 1990, entitled, "Easy Threading Stretch Wrapper".

Abstract, Doc. No. EP 220 712A, May 1987.

*Primary Examiner*—Linda B. Johnson

*Attorney, Agent, or Firm*—Finnegan, Henderson, Farabow, Garrett & Dunner

[57] ABSTRACT

A stretch wrapping apparatus includes a dispenser for dispensing stretch wrap packaging material. The dispenser includes upstream and downstream prestretch rollers for engaging and stretching stretch wrap packaging material. The dispenser also includes an intermediate orienting roller positioned between the upstream and downstream prestretch rollers. The intermediate orienting roller abuts one of the upstream and downstream prestretch rollers, and is spaced from the other of the upstream and downstream prestretch rollers. Relative rotation is provided between the dispenser and the load to wrap the stretch wrap packaging material around the load.

17 Claims, 7 Drawing Sheets

STRETCH WRAPPING APPARATUS

BACKGROUND OF THE INVENTION

The invention relates to stretch wrapping apparatus having prestretch rollers which stretch packaging material before wrapping a load.

Stretch wrapping is a packaging technique which dispenses and wraps a web of stretch wrap packaging material in a stretched condition around the load to cover and contain the load.

Early stretch wrapping techniques positioned the load on a turntable and fastened the leading end of the web of stretch wrap packaging material to the load or the turntable. As the turntable rotated, the roll of stretch film was restrained by a brake to stretch the packaging material in the direction in which it was being dispensed as the packaging material was wrapped around the load. A similar stretch wrapping technique revolved a film web dispenser around a stationary load to wrap the stretched film around the load.

As the field of stretch wrapping developed, Lantech invented a stretch wrapping apparatus which employed a film web dispenser having two closely spaced rollers to stretch a web of thermoplastic stretch film packaging material. Such rollers are known as prestretch rollers. The downstream prestretch roller has a faster surface speed than the upstream prestretch roller. This stretches the packaging material between the upstream and downstream prestretch rollers in the dispensing direction.

These closely spaced prestretch rollers were driven by the demand for film web by the load and were sometimes assisted by an electrical motor. In one arrangement, the two prestretch rollers included sprockets which were connected by an endless chain to cause the downstream prestretch roller to have a faster surface speed than the upstream roller and thereby stretch the web of stretch film over its yield point in the dispensing direction.

It is preferable that a stretch wrapping apparatus with prestretch rollers have the following features. The upstream and downstream prestretch rollers should be closely spaced during operation to prevent neckdown of the film web as it is being substantially stretched in the dispensing direction. Since the forces exerted on a wide web of stretch film between the prestretch rollers is very significant, in the order of 50 pounds of force, the frame and the mounting of the prestretch rollers should be required to be very sturdy. The surface of the prestretch rollers should be covered by the stretch film over a sufficient extent such that the stretch film does not slip on the prestretch rollers. The rotational inertia of the prestretch rollers should not be so high as to require excessively high power to vary their velocity.

To accommodate these requirements, a series of idler rollers are used to support the stretch film proximate to the prestretch rollers and maintain the tack side of the film web facing the prestretch rollers. As a result, the film web follows a tortuous path around the closely spaced prestretch and idler rollers.

Before operating a stretch wrapping apparatus having prestretch rollers, it is necessary to thread the stretch film along the tortuous path. This threading operation is difficult and time consuming because due to the close spacing of the rollers, an operator cannot manually carry the stretch wrap packaging material between the rollers. Rather, the operator must feed the stretch wrap packaging material from one side of each roller nip with one hand and pull the stretch film from the other side of the roller nip with the other hand. This procedure is rendered considerably more difficult because of the large widths of the stretch wrap packaging material which are used commercially. Such webs generally have a width in the range of 10 to 30 inches. Other problems in threading resulted from the fact that the operator was required to place his fingers proximate to the nip of the rollers and blindly feed the film from the rear of the frame which carried the rollers, which made the threading operation difficult and more time consuming.

Lantech addressed the threading problem in one of its earlier patents, U.S. Pat. No. 4,747,254, which is incorporated herein by reference. This earlier arrangement reduced the difficulty of threading a web along a tortuous path by using a retractable leader which ran generally parallel to the path of the film web around the rollers to lead the film along the path. However, this arrangement required the leading end of the film web to be attached to the leader and the leader to be slowly pulled through the tortuous path while rotating the prestretch rollers, releasing the film web from the leader and retracting the leader.

To overcome a number of these difficulties, Lantech designed and commercialized a stretch wrapping apparatus which is disclosed in U.S. patent application Ser. No. 07/611,114 now abandoned, which is incorporated herein by reference. This apparatus employed a first dispenser frame assembly for supporting the upstream and downstream prestretch rollers, and a second dispenser frame assembly for supporting the idler rollers. The frame assembly for supporting the idler rollers could be pivoted away from the frame assembly for supporting the upstream and downstream rollers so as to provide an open loading position in which the stretch wrap packaging material could be easily carried between the idler rollers and the prestretch rollers, and a closed operating position in which the idler rollers were proximate to but spaced from the upstream and downstream prestretch rollers.

SUMMARY OF THE INVENTION

It is an object of the present invention to provide a stretch wrapping apparatus in which film abrasion, scuffing and neck down is minimized, film traction on the prestretch rollers is increased, and film quality is improved during stretching and wrapping.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

To achieve the foregoing objects, and in accordance with the purposes of the invention as embodied and broadly described herein, a stretch wrapping apparatus is provided which includes a dispenser for dispensing stretch wrap packaging material. The dispenser includes upstream and downstream prestretch rollers for engaging and stretching stretch wrap packaging material. The dispenser also includes an intermediate orienting roller positioned between the upstream and downstream prestretch rollers. The intermediate orienting roller abuts one of the upstream and downstream prestretch rollers and is spaced from the other of the upstream and downstream prestretch rollers. Relative rotation is provided between the dispenser and the load to wrap the stretch wrap packaging material around the load.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Reference will now be made in detail to the present preferred embodiment of the invention as illustrated in the accompanying drawings.

Figure 5:
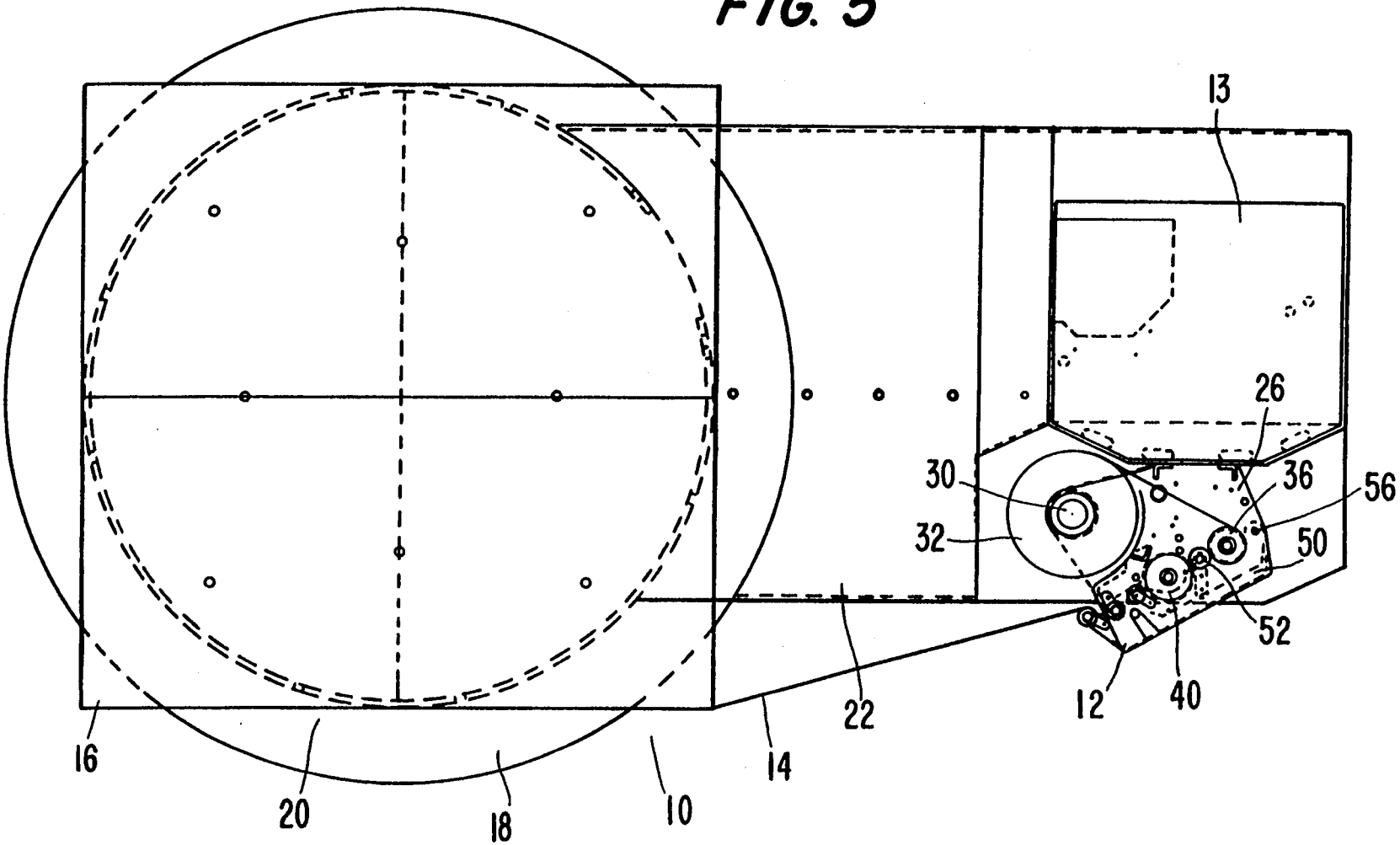
FIG. 5 is a top view of a stretch wrapping apparatus according to the present invention including the arrangement shown in FIG. 1.
Figure 6:
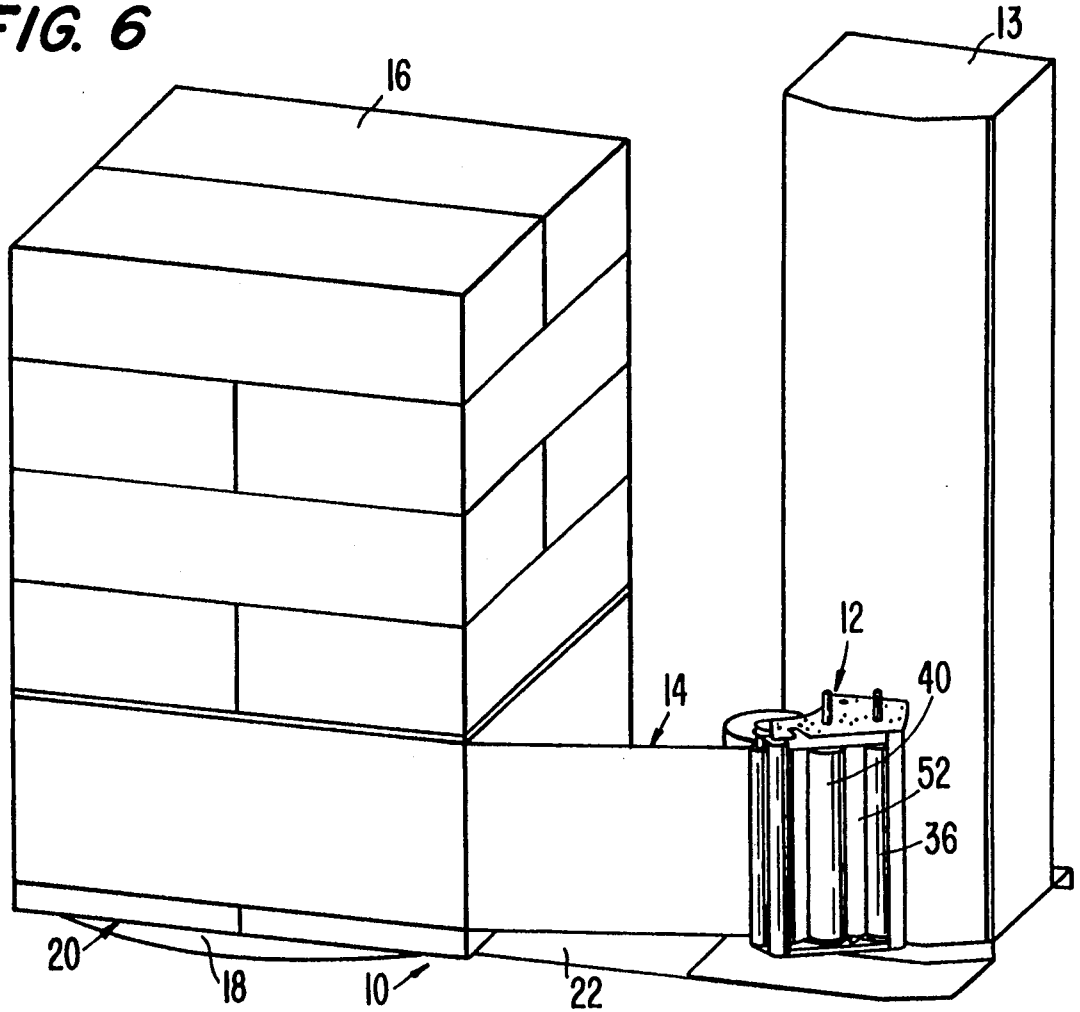
FIG. 6 is a perspective view of the stretch wrapping apparatus shown in FIG. 5.

According to the present invention, an apparatus is provided for stretch wrapping a load. The apparatus includes a dispenser for dispensing stretch wrap packaging material and means for providing relative rotation between the dispenser and a load to wrap the stretch wrap packaging material around the load. As shown in FIGS. 5 and 6, a stretch wrapping apparatus 10 includes a dispenser 12 for dispensing stretch wrap packaging material 14 onto a load 16 which is to be wrapped by the stretch wrapping apparatus 10.

As shown in FIGS. 5 and 6 the means for providing relative rotation between the dispenser 12 and the load 16 is a turntable assembly 18 which includes a turntable 20 mounted to rotate about a base 22 which supports the turntable. The turntable assembly also includes a motor drive assembly which drives turntable 20 about base 22. This causes the stretch wrap packaging material 14 to be wrapped around the load 16 after it has been dispensed from dispenser 12. The means for providing relative rotation between the dispenser 12 and the load 16 alternatively can include a mechanism for rotating the dispenser 12 around a stationary load 16. The details of the means for providing relative rotation do not form a part of the present invention and can be accomplished by commercially available turntable assemblies such as those made by Lantech, Inc. of Louisville, Ky. or similar means.

As embodied in FIG. 5, the dispenser 12 includes a first dispenser frame assembly 26 with an upstream and downstream prestretch roller assembly, and a spindle 30 for supporting a roll 32 of stretch wrap packaging material 14 and for orienting the packaging material 14 along a desired path and obtaining a desired degree of wrap on the prestretch rollers.

The upstream and downstream prestretch roller assembly includes an upstream prestretch roller 36 and a downstream prestretch roller 40 which preferably are driven by a motor with a chain and sprocket drive at a preselected velocity ratio.

The surfaces of prestretch rollers 36 and 40 may be a suitable nonslip substance such a coating made of vinyl plastisol, such as Louisville Mill Supply product B616, which has been foamed and machined as described in U.S. patent application Ser. No. 07/289,442, which is incorporated by reference. The prestretch roller assembly maintains the surface speed of the downstream prestretch roller 40 at a speed which is faster than the speed of the upstream prestretch roller 36 to stretch the stretch wrap packaging material between the prestretch rollers 36 and 40. In some applications, it is desirable to stretch the packaging material over its yield point to plastically deform the film in the direction in which it is being dispensed.

As here embodied, dispenser 12 includes a second dispenser frame assembly 50 having an intermediate orienting roller 52 positionable between the upstream and downstream prestretch rollers 36 and 40. Intermediate orienting roller 52 is an idler roller mounted to rotate on a journal mounted on support 53 of second dispenser frame assembly 50. Intermediate orienting roller 52 preferably has a resilient surface, for example a vinyl plastisol such as Louisville Mill Supply product B616.

As depicted in FIG. 5, a hinge 56 pivots the first and second dispenser frame assemblies 26 and 50 relative to each other about a single axis which is generally perpendicular to the principal axes or axes of rotation for prestretch rollers 36 and 40. During the relative pivoting, the first dispenser frame assembly 26 may be fixed and the second dispenser frame assembly 50 may be manually moved by the operator.

A releasable latch may be used for releasably locking the first and second dispenser frame assemblies 26 and 50 together in the operating position shown in FIG. 5. The releasable latch may be a slam latch which locks the first and second dispenser frame assemblies 26 and 50 together in the operating position shown in FIG. 5 when the first and second dispenser frame assemblies 26 and 50 are slammed together from an open loading position the closed operating position shown in FIG. 5. First and second dispenser frame assemblies 26 and 50, hinge 56 and slam latch allow the operator of the stretch wrapping apparatus to close the first and second dispenser frame assemblies 26 and 50 in an exact relationship.

When the intermediate orienting roller 52 is in the closed operating position shown in FIG. 5, it is proximate to both the upstream and downstream prestretch rollers 36 and 40 for carrying the stretch wrap packaging material 14 between the upstream and downstream prestretch rollers 36 and 40 and preventing neckdown of the stretch wrap packaging material 14 being stretched between the upstream and downstream prestretch rollers 36 and 40.

While it is preferable to use a dispenser which is constructed on two frames to open for the convenience of threading the stretch wrap packaging material, such an arrangement is not essential to practicing the invention. In particular, it is possible to employ the invention in a dispenser which does not open and close.

Figure 1:
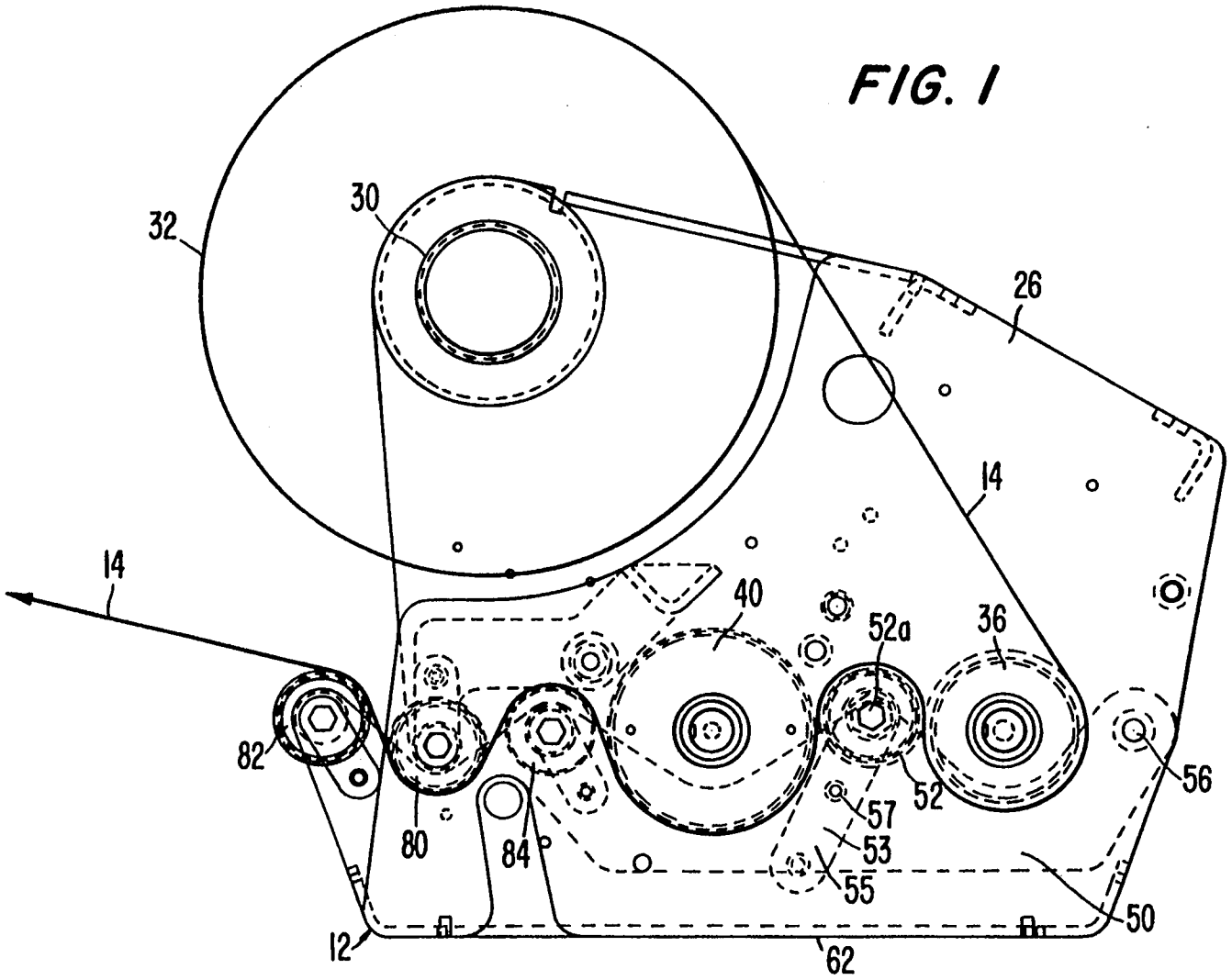
FIG. 1 is a partial top view of a stretch wrapping apparatus according to the present invention.
Figure 4:
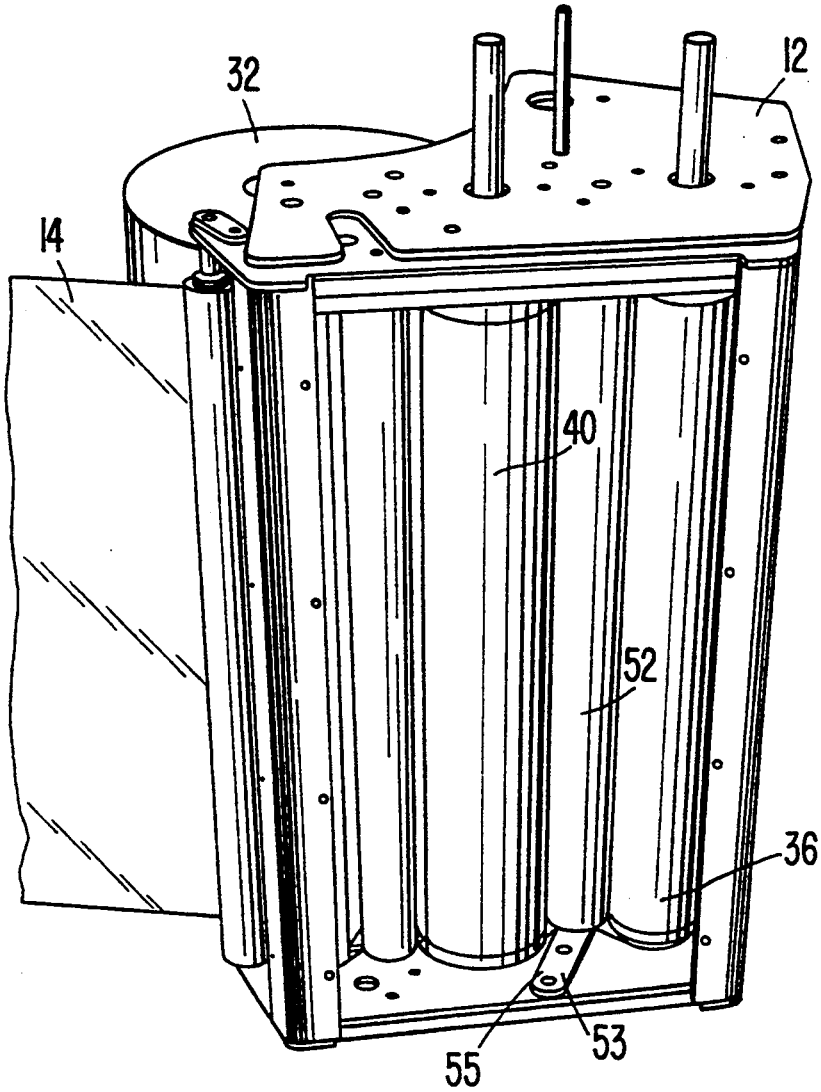
FIG. 4 is a perspective view of the apparatus shown in FIG. 1.

According to the present invention, the intermediate orienting roller is positioned between the upstream and downstream prestretch rollers, abutting one of the upstream and downstream prestretch rollers, and spaced from the other of the upstream and downstream prestretch rollers. As shown in FIG. 1, intermediate orienting roller 52 is mounted on a support 53. As shown in FIGS. 1 and 4, support 53 may include plates 55 which are mounted to pivot about axis 57 by way of a fastener such as a bolt, mounted at axis 57. Intermediate orienting roller 52 is pivoted to allow it to ride along the surface of one of the upstream and downstream prestretch rollers. In doing so, intermediate orienting roller 52 is positioned so that it is abutting upstream prestretch roller 36 and spaced from downstream prestretch roller 40.

A second fastener such as a bolt is mounted at axis 59 to pass through a hole in plates 55 so as to have play between the bolt and the hole. This permits intermediate orienting roller 52 to be generally positioned in an appropriate location relative to the prestretch rollers 36 and 40 and to allow it to be biased into abutment with one or the other prestretch rollers 36 or 40.

In previous arrangements, an intermediate orienting roller was proximate to but spaced from both the upstream and downstream prestretch rollers. In comparison, in the present invention, the intermediate orienting roller is positioned so that rather than having two gaps between the stretch rollers, there is only one gap between the stretch rollers. This in turn reduces the amount of unsupported film by 100%. Reducing the amount of unsupported film, reduces the amount of neckdown in the width dimension of the film. This generates a greater area stretch of the film.

Figure 2:
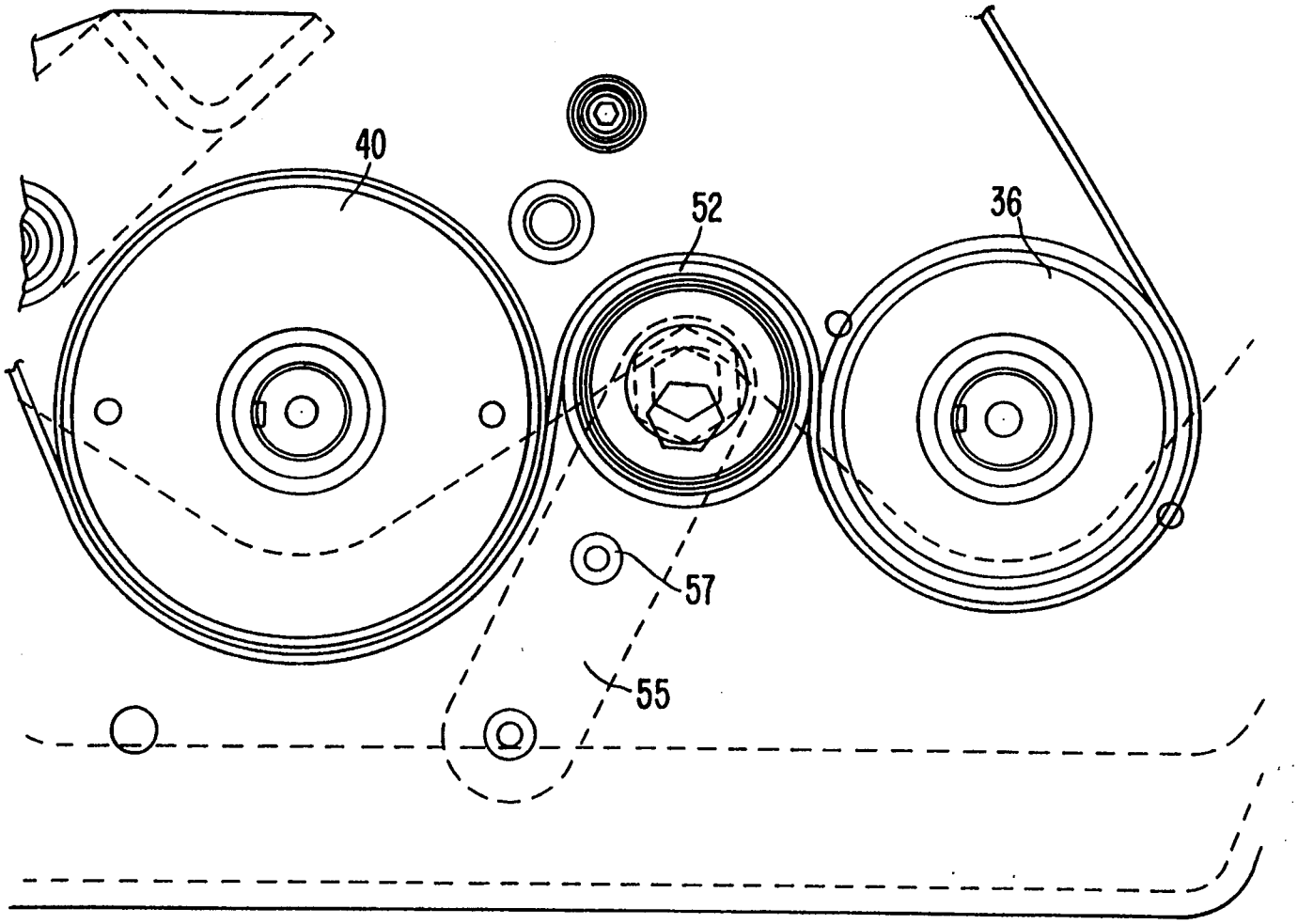
FIG. 2 is an enlarged partial view of FIG. 1.
Figure 3:
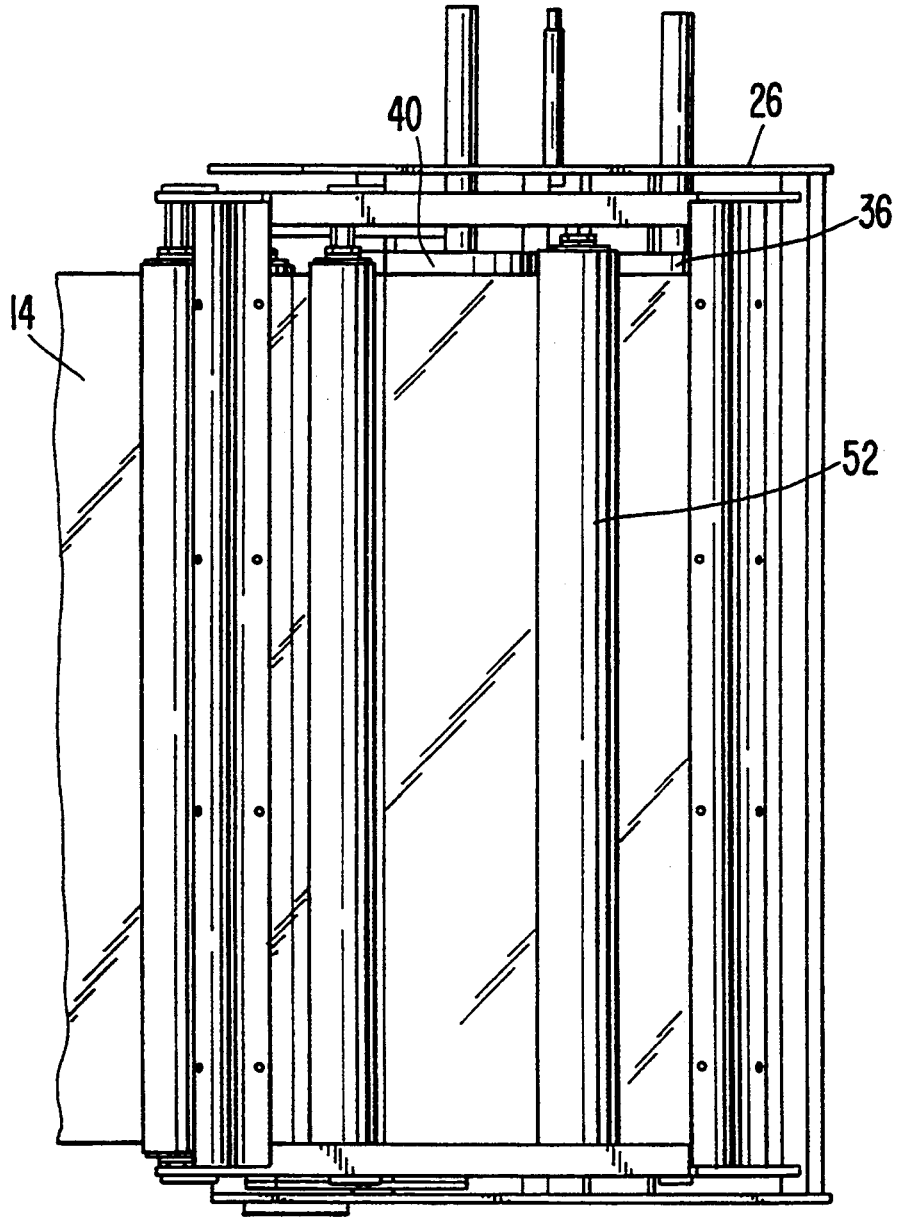
FIG. 3 is a side view of the stretch wrapping apparatus shown in FIG. 1.

The intermediate orienting roller 52 preferably is biased against the prestretch roller which it is abutting. As shown in FIG. 2, intermediate orienting roller 52 is biased against upstream prestretch roller 36. The pivot axis 57 is mounted at a location which during operation permits the stretch wrap packaging material to bias the intermediate orienting roller against the upstream prestretch roller 36. This is achieved through the force vector resulting from the geometry of the mountings and force application by the packaging material. Alternatively, the biasing may be achieved through the use of a spring or similar element.

As shown in FIG. 1, the result of this arrangement is that the intermediate orienting roller 52 is abutting upstream prestretch roller 36 so that those two rollers are separated by the thickness of the film and rotate at generally identical surface speeds. Intermediate orienting roller 52 effectively acts like a pinch roller or press roller in relation to the roller it abuts. As a pinch roller or press roller, intermediate orienting roller 52 effectively acts as an extension of the prestretch roller which it abuts by offering increased surface for the traction to the film. In doing so, the intermediate orienting roller pinches the film between itself and the prestretch roller which it abuts to offer greater traction. Increased traction of the prestretch rollers reduces the damage to the film in the machine direction by decreasing the abrasion of the film. The intermediate orienting roller is smaller in diameter than the prestretch roller and therefore allows the film to disengage from its surface quicker which appears to reduce the opportunity for abrasions.

As previously noted, intermediate orienting roller 52 preferably has a resilient surface such as vinyl plastisol. As such, the intermediate orienting roller has a surface that allows even contact along the full width of the film web. The preferable use of the B616 coating on the intermediate orienting roller grips the film and reduces the neckdown abrasion.

In contrast to its abutting relationship to upstream prestretch roller 36, intermediate orienting roller 52 is spaced from downstream prestretch roller 40 to provide a gap over which the stretch wrap packaging material is stretched between the slower moving intermediate orienting roller 52 and the faster moving downstream prestretch roller 40. An example of the relative placement and relationship of the rollers without the stretch wrap packaging material present is shown in FIG. 2.

While it is presently preferable that the intermediate orienting roller abuts the upstream prestretch roller and is spaced from the downstream prestretch roller, it is within the scope of the claimed invention for the intermediate orienting roller to be abutting the downstream prestretch roller and spaced from the upstream prestretch roller.

Under current commercial conditions, when the intermediate orienting roller 52 is in the operating position, the proximity of its surface to the surface of the prestretch roller 40 from which it is spaced should not exceed approximately one quarter inch and preferably is in the range of approximately one sixteenth to one eighth inches.

Prestretch rollers 36 and 40, and intermediate orienting roller 52 preferably are each mounted in their respective frames so as to be only rotatable with respect to their respective frames and not translatable with respect to their relative frames to provide a fixed, solid construction which is required under the high forces which are exerted in this area.

As shown in FIGS. 5 and 6, additional components may be provided for enabling the dispenser to be mounted on a mast 13 and raised and lowered to perform a typical spiral wrapping operation.

As shown in the operating position illustrated in FIGS. 1 and 2, prestretch rollers 36 and 40 are spaced at a distance approximately slightly greater than the diameter of intermediate orienting roller 52.

The axis **52*a* of the intermediate orienting roller 52 may be positioned generally in the vicinity of the center line between prestretch rollers 36 and 40 when the dispenser is in the operating position shown in FIG. 1. The axis 52*a* of the intermediate orienting roller 52 may be moved across the center line CL between the prestretch rollers 36 and 40 when the dispenser is moved between the loading position and the operating position shown in FIG. 1**.

Figure 7:
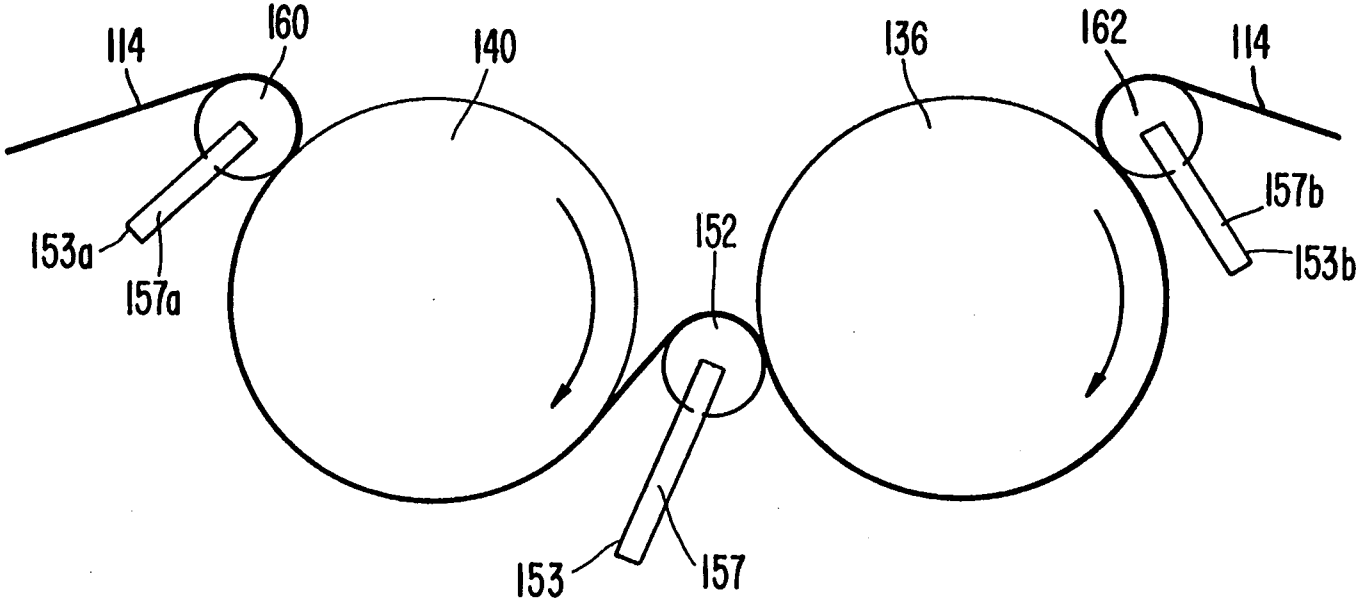
FIG. 7 is a schematic partial top view of a second embodiment of the stretch wrapping apparatus according to the present invention.

According to one aspect of the invention, it is preferable to have at least one secondary orienting roller spaced from the intermediate orienting roller and abutting one of the prestretch rollers. As shown in FIG. 7, a secondary orienting roller 160 is spaced from intermediate orienting roller 152 and abuts the downstream prestretch roller 140 when in the operating position. Similarly, another secondary orienting roller 162 is spaced from intermediate orienting roller 152 and abuts the upstream prestretch roller 136.

Like intermediate orienting roller 152, secondary orienting rollers 160 and 162 are idler rollers and are mounted on respective supports **153*a* and 153*b* to pivot about respective axes 157*a* and 157*b* by way of a fastener or other means mounted at respective axes 157*a* and 157*b***.

Once again, similar to intermediate orienting roller 152, secondary orienting rollers 160 and 162 are preferably biased against the prestretch roller which it is abutting. The pivot axes 157, 157*a* and 157*b* may be mounted at locations which during operation permit the stretch wrap packaging material to bias the respective orienting rollers against the prestretch rollers which they respectively abut. This biasing may be achieved through the geometry of the mountings in the force application by the packaging material such that the configuration creates a vector force pushing the orienting roller against the stretch roller which it abuts. Alternatively, the biasing may be achieved through the use of a spring or similar element.

The second dispenser frame assembly 50 may include a guard 62 which shields an operator from touching the prestretch rollers 36 and 40 when the dispenser is in the closed operating position shown in FIG. 1. Guard 62 may be a sheet of plexiglass which extends around the outside of second dispenser frame assembly 50.

A cutoff switch may be provided for cutting off electrical power to the stretch wrapping apparatus and particularly the power to prestretch motor drive when the dispenser is in a position other than the closed position. The cutoff switch can be a spring loaded limit switch which is mounted on the first dispenser frame assembly 26 and is engaged by an activator arm positioned on second frame assembly 50 when the dispenser is in a closed position such as FIG. 1. When the dispenser is in an open position, the activator arm does not engage cutoff switch and the cutoff switch interrupts the electrical power to the prestretch motor of the stretch wrapping apparatus. This is a safety feature which prevents the stretch wrapping apparatus from operating when the dispenser is in a position other than the closed position shown in FIG. 1.

Orienting roller 80 is mounted on dispenser frame 26, and may be a dancer roller which activates the cutoff switch to supply electrical power to the stretch wrapping apparatus when the stretch wrap packaging material is threaded through the stretch wrapping apparatus, the dispenser is in the closed position and the stretch wrap packaging material is tensioned. Orienting rollers 82 and 84 are mounted on dispenser frame 50 to increase the wrap angle on roller 40 and keep the orientation of film web 14 at a constant angle on roller 80.

One end of orienting roller 80 may be mounted in a slotted spring loaded journal which allows the orienting roller to be displaced approximately one quarter inch when the stretch wrap packaging material is tensioned. The displacement of the orienting roller can activate the cutoff switch to supply electrical power to the stretch wrapping apparatus when the stretch wrapped packaging material is tensioned.

Additional advantages and modifications will readily occur to those skilled in the art. The invention in its broader aspect is, therefore, not limited to specific details, representative apparatus and illustrative example shown and described. Accordingly, departures may be made from such details without departing from the spirit or scope of the general inventive concepts as defined in the appended claims and their equivalents.

What is claimed is:

1. A stretch wrapping apparatus comprising:

a dispenser for dispensing stretch wrap packaging material including upstream and downstream prestretch rollers for engaging and stretching stretch wrap packaging material, and an intermediate orienting roller positioned between the upstream and downstream prestretch rollers, abutting one of the upstream and downstream prestretch rollers and spaced from the other of the upstream and downstream prestretch rollers, for changing the direction of curvature and forming an S-shaped pattern of stretch wrap packaging material where the intermediate orienting roller abuts the abutting one of the upstream and downstream prestretch rollers; and means for providing relative rotation between the dispenser and a load to wrap the stretch wrap packaging material around the load.

2. The stretch wrapping apparatus of claim 1, wherein the intermediate orienting roller is biased against the prestretch roller which it is abutting.

3. The stretch wrapping apparatus of claim 1, wherein the intermediate orienting roller is pivotable about an axis parallel to but offset from its principal axis.

4. The stretch wrapping apparatus of claim 3, the intermediate orienting roller is biased against the prestretch roller to which it is abutting.

5. The stretch wrapping apparatus of claim 3 wherein the pivot axis is mounted at a location with mounting means which during operation permits the stretch wrap packaging material to bias the intermediate orienting roller against the prestretch roller which it is abutting.

6. The stretch wrapping apparatus of claim 1, wherein the distance between the intermediate orienting roller and the prestretch roller from which it is spaced does not exceed approximately one quarter inch.

7. The stretch wrapping apparatus of claim 1, wherein the distance between the intermediate orienting roller and the prestretch roller from which it is spaced in the range of one sixteenth to one eighth inch.

8. The stretch wrapping apparatus of claim 1 wherein the prestretch rollers are spaced at a distance slightly greater than the diameter of the intermediate orienting roller.

9. The stretch wrapping apparatus of claim 1 wherein the principal axis of the intermediate orienting roller is positioned generally in the vicinity of the center line between the prestretch rollers.

10. The stretch wrapping apparatus of claim 1 including at least one secondary orienting roller spaced from the intermediate orienting roller and abutting one of the prestretch rollers.

11. The stretch wrapping apparatus of claim 10 wherein the secondary orienting roller is positioned downstream of the downstream prestretch roller and abutting the downstream prestretch roller.

12. The stretch wrapping apparatus of claim 10 wherein the principal axes of the intermediate orienting roller and the secondary orienting roller are positioned generally in the vicinity of the center line connecting the prestretch rollers.

13. The stretch wrapping apparatus of claim 10 wherein the secondary orienting roller is positioned upstream of the upstream prestretch roller and abutting the upstream prestretch roller.

14. The stretch wrapping apparatus of claim 10 wherein the secondary orienting roller includes a roller positioned downstream of the downstream prestretch roller and abutting the downstream prestretch roller, and another roller positioned upstream of the upstream prestretch roller and abutting the upstream prestretch roller.

15. The stretch wrapping apparatus of claim 1 wherein the intermediate orienting roller has a resilient surface.

16. The stretch wrapping apparatus of claim 1 wherein at least one of the intermediate orienting roller and the prestretch roller it abuts has a resilient surface.

17. The stretch wrapping apparatus of claim 1 wherein the intermediate orienting roller is smaller in diameter than the upstream and downstream prestretch rollers.

* * * * *

UNITED STATES PATENT AND TRADEMARK OFFICE

CERTIFICATE OF CORRECTION

PATENT NO. : 5,414,979
DATED : May 16, 1995
INVENTOR(S) : Moore et al.

It is certified that error appears in the above-indentified patent and that said Letters Patent is hereby corrected as shown below:

Claim 7, column 8, line 38, after "spaced", insert --is--.

Signed and Sealed this

Fifteenth Day of August, 1995

*Attest:*

*Attesting Officer*

BRUCE LEHMAN

*Commissioner of Patents and Trademarks*